US006221833B1

(12) United States Patent
Colurciello, Jr.

(10) Patent No.: US 6,221,833 B1
(45) **Date of Patent: *Apr. 24, 2001**

(54) CLEANING AND SURFACE TREATMENT COMPOSITIONS CONTAINING SILCONE OILS

(75) Inventor: Andrew Francis Colurciello, Jr., Newburgh, NY (US)

(73) Assignee: Reckitt Benckiser Inc., Wayne, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/098,569

(22) Filed: Jun. 17, 1998

(30) Foreign Application Priority Data

Oct. 1, 1997 (GB) ..... 9720699

(51) Int. Cl.[7] ..... C11D 3/37; C11D 9/36

(52) U.S. Cl. ..... 510/466; 510/189; 510/244; 510/245; 510/268; 510/364; 510/365; 510/405; 510/417; 510/421; 510/426; 510/427; 510/499; 134/40; 134/42

(58) Field of Search ..... 510/189, 244, 510/245, 268, 364, 365, 405, 417, 421, 426, 427, 466, 499; 134/40, 42

(56) References Cited

U.S. PATENT DOCUMENTS

| | | | | |
|---|---|---|---|---|
| 3,956,174 | | 5/1976 | Palcher | 252/400 |
| 4,133,921 | | 1/1979 | Palcher | 427/355 |
| 4,822,514 | | 4/1989 | Becker | 252/108 |
| 4,898,614 | | 2/1990 | Halloran et al. | 106/3 |
| 5,183,845 | * | 2/1993 | Parkinson et al. | 524/726 |
| 5,227,200 | * | 7/1993 | LeGrow | 427/387 |
| 5,310,783 | | 5/1994 | Bernheim et al. | 524/837 |
| 5,432,217 | * | 7/1995 | O'Lenick | 524/247 |
| 5,518,533 | * | 5/1996 | Howe | 106/3 |
| 5,661,208 | * | 8/1997 | Estes | 524/457 |
| 5,693,704 | * | 12/1997 | Estes | 524/506 |
| 5,866,532 | * | 2/1999 | Jackson et al. | 510/466 |

FOREIGN PATENT DOCUMENTS 0 008 209 2/1980 (EP) .

OTHER PUBLICATIONS

Technical Bulletin: Carbopol Resins, Goodrich Co., date and place of publication unknown. No date Given.
Great Britan Patent Office Search Report for Application No. GB 9720699.9, Feb. 4, 1998, Gwent, England.
Thickening & Suspending with Carbopol Resins. Goodrich Co. pp. 2–15, No Date Given.*

* cited by examiner

*Primary Examiner*—Mark Kopec
*Assistant Examiner*—Brian P. Mruk
(74) *Attorney, Agent, or Firm*—Fish & Richardson P.C.

(57) ABSTRACT

Cleaning and surface treatment compositions which are particularly useful in the cleaning of leather, vinyl, plastic, rubber and other similar surfaces as well as providing a surface coating thereupon. The cleaning compositions include reduced amounts of emulsified silicone oils in an aqueous formulation. The compositions are readily dispensible from conventional dispensing devices, and provide simultaneous cleaning to a treated surface, as well as imparting a glossy surface coating.

17 Claims, No Drawings

CLEANING AND SURFACE TREATMENT COMPOSITIONS CONTAINING SILCONE OILS

FIELD OF THE INVENTION

The present invention relates to cleaning and surface treatment compositions containing emulsified silicone oils as a constituent. More particularly the present invention relates to cleaning and surface treatment compositions which are particularly useful in the cleaning of leather, vinyl, plastic, rubber and other similar surfaces as well as providing a glossy surface coating thereupon. The invention provides a composition, which both cleans and improves the appearance of such surfaces without imparting a tacky or greasy feel to such surfaces.

BACKGROUND OF THE INVENTION

Known to the art are a variety of compositions, which are marketed for the purpose of providing a glossy sheen to surfaces such as leather, vinyl, plastic, rubber and other similar materials. These surfaces are generally to be found, for example, in many automotive and household environments such as in automobile dashboards, center consoles, door interiors, non-fabric seats, as well as on the surfaces and coatings of many household appliances, and such objects as helmets, sporting equipment and the like.

Such known art compositions generally provide a gloss or sheen subsequent to their application due to the fact that they are comprised of a considerable proportion of silicone oil generally in amounts of about 20–25 wt % and even greater. Further constituents such as glycerin also aid in the gloss-providing aspects of such compositions and thus are also frequently found. While such constituents may be beneficial in improving the gloss and shine, and hence the appearance of such surfaces, they frequently concomitantly impart an undesired tacky or greasy feel to the treated surfaces. Furthermore, as such known art compositions generally provide little or no cleaning benefit, prior to their application the use of a cleaning composition is necessitated. This dictates that the consumer purchase two different products and use them in a two-step process. This is not particularly favorable from the consumer's standpoint.

Exemplary formulations of this type are demonstrated, for example, in U.S. Pat. No. 3,956,174 wherein are illustrated compositions consisting of emulsified organopolysiloxane fluids and polyol compounds. Compositions providing a glossy sheen to such surfaces as described above are described in U.S. Pat. No. 5,183,845, which describes an emulsion containing dimethylpolysiloxanes and amino functional dimethylpolysiloxanes of varying viscosities combined with wetting agents and rain out agents necessary to "wet" the surface and break the emulsion on the surface.

Further compositions are illustrated in U.S. Pat. No. 5,310,783 wherein are described dispersed aqueous compositions used for the treatment of fibers and consisting of organopolysiloxanes containing organic radicals and amino and/or amido groups. However, none of the inventions cited above is directed toward the cleaning of surfaces.

A unique example of a composition effecting both cleaning and shining capabilities is found in U.S. Pat. No. 4,822,514 wherein are described dilutable and sprayable cleaning compositions which impart gloss or shine to surfaces which are also thereby effectively cleaned. The molecular components of this composition comprise a vegetable oil based surfactant/detergent system, which tends to impart a greasy coating to the surface treated thereby.

All such compositions are known to provide varying levels of shine and thus improve the attractiveness of the surfaces they are used to treat. Unfortunately, they also frequently deposit a greasy residue due to the presence of significant levels of silicone oils, as well as other gloss-contributing constituents such as glycerin. And, as noted previously most such known compositions provide little or no cleaning benefit. Accordingly, there is a need in the art for improved compositions which will provide a beneficial cleaning effect as well as importing a gloss or shine to a treated surface. Surfaces such as vinyl, rubber, plastic, leather, and the like are particularly of interest.

SUMMARY OF THE INVENTION

It is an object of the invention to provide an aqueous emulsion comprising silicon oils and amino-functionalized silicon oils, an emulsifier, non-ionic and anionic surfactants and one or more organic solvents for the cleaning and polishing of the variety of surfaces mentioned above. It is a further object of the invention to provide a process useful for the cleaning and shining of such surfaces which process comprises a step of applying a single ready-to-use product formulated to achieve these ends. These and other objects of the invention are satisfied by the improved compositions taught below.

According to one aspect of the invention there is provided a composition for the cleaning and shining of leather, vinyl, plastic, rubber and like surfaces wherein such composition includes: an organopolysiloxane fluid, a carboxypolyalkylene emulsifier, an amino-functional organopolysiloxane-containing fluid, a nonionic surfactant including at least one non-ionic surfactant selected from the group consisting of alkoxylated alcohols and alkoxylated alkylphenols, an anionic sulfated or sulfonated surfactant and one or more organic solvents. The composition optionally but desirably may further include one or more conventional additives including but not limited to chelating agents, pH-adjusting agents, coloring agents, fragrance adjuvents, preservatives, biocides, anti-corrosion agents, particularly for use in aerosol containers, as well as others not particularly recited here.

The composition according to the invention comprises a major proportion of water and, particularly as compared to the known prior art formulations described above, a reduced proportion of silicone oils. The new compositions may be further distinguished from many of these prior art compositions in that they not only impart a glossy or shiny effect subsequently to their application, are also non-greasy to the touch after their drying, and simultaneously provide a significant cleaning effect in a single application.

According to a further aspect of the invention there is provided a process for making the aforementioned composition. This process comprises homogenizer-assisted dispersal of the carboxypolymethylene emulsifier in most or all of the volume of water, followed by addition of the organopolysiloxane fluid, followed by the addition of the nonionic and anionic surfactants, followed by pH adjustment, thereafter followed by the addition of the remaining constituents in any order. Mixing is to be continued until a visibly whitish emulsion is formed.

According to a still further aspect of the invention there is provided a process for treating and cleaning a surface with the above-mentioned composition which comprises applying an effective amount of the composition to a surface to be treated and cleaned, carrying out a light rubbing or buffing action with a cloth, sponge or other like cleaning material, and finally removing the composition from the surface with a cloth, sponge or other like cleaning material. Other features and advantages of the invention will be apparent from the following detailed description, and from the claims.

DETAILED DESCRIPTION OF THE INVENTION

The composition of the invention requires at least one organopolysiloxane fluid. These fluids are also commonly referred to as "silicone oils" and are distinguished from silicone elastomers and resins, which are more thoroughly cross-linked than silicon oils. The fluids are based on or consist of organopolysiloxanes. The structure of one particular organopolysiloxane, dimethylpolysiloxane, is shown by the following general formula:

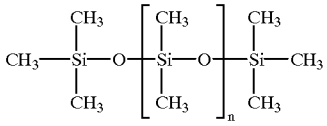

wherein n is the number of repeating groups and is a value of at least 10, and may be a value as great as one million or more, but more commonly has a value of between about 50 and 1000. By substitution of some of the methyl groups with other organic or functionalized organic groups, such as vinyl, phenyl, trifluoropropyl, and amino, other organopolysiloxanes can be produced. Any of these can be used in the inventive composition. The use of compositions containing phenyl and other substituted organopolysiloxanes is a matter of choice, depending upon the material to be treated and/or the environmental stresses to which the surface will be exposed. The organopolysiloxane fluids may comprise one or more different organopolysiloxanes.

The organopolysiloxanes in the compositions are believed to be responsible for waterproofing rubber and to impede scission. Scission is a process by which the rubber surface is altered leading to cracking, providing increased permeability to destructive agents in the environment. Scission is promoted by the presence of ozone and oxygen; organopolysiloxane is believed to help to exclude those materials.

Organopolysiloxanes are also useful for imparting a glossy coating to the surface to be treated, resulting in an improved appearance. The organopolysiloxanes or mixtures thereof are used in the form of water emulsions to promote ease of application and compatibility with anionic surfactants used to attain the cleaning function of the present composition. The organopolysiloxanes are available as pure constituents, or in an emulsion. Emulsions of organopolysiloxanes in water are available from several major chemical companies, including for example, General Electric Company, Silicone Products Department of Waterford, N.Y.; Union Carbide Corporation, Silicones Division of West Virginia; and Dow Corning Corporation of Midland, Mich. Such organopolysiloxane emulsions usually contain from about 35% to about 50% by weight of an organopolysiloxane or mixture of organopolysiloxanes, with the remainder being mostly water and small amounts of emulsifier and adjuvant materials such as a rust inhibitor. A typical organopolysiloxane emulsion contains 35 parts by weight organopolysiloxane, 10 parts by weight of an emulsifier, 5 parts by weight of a rust inhibitor, such as sodium nitrite, and 65 parts by weight of water. Percentages by weight are taken to refer to the weight of active ingredients in the fluid. In the present invention, the use of pure organopolysiloxane fluids is preferred.

Generally available organopolysiloxane fluids typically contain mixtures of polymers of varying chain length. The variation in chain length leads to varying viscosity of organopolysiloxane fluids. It has been found for purposes of the invention that the viscosity of the organopolysiloxane fluids can serve as an indication of their protective effectiveness for more permeable surfaces such as rubber. Apparently, as the viscosity becomes too great, there is difficulty in penetration of organopolysiloxane fluids into the surface to be protected. When the viscosity becomes too low, the average chain length of polymer is apparently too small to provide adequate protection. Desired organopolysiloxane fluids can be used which have a viscosity range up to about 100,000 centistokes. Preferably, the viscosity of the organopolysiloxane fluids to be used should be in the range of from about 50 centistokes up to about 10,000 centistokes. Most preferably, the viscosity of the organopolysiloxane fluid is in the range of about 100–300 centistokes.

One example of an organopolysiloxane fluid is sold as Dow Corning 200 dimethylsilicone fluid. This product is readily available and entirely suitable.

It is contemplated that good aqueous emulsion compositions according to the invention generally are obtained when they contain no less than about 5% by weight and no more than about 20% by weight of organopolysiloxane fluid with viscosities of between about 100 and 300 cst. If the amount of the organopolysiloxane fluid is reduced to less than about 5% by weight, then the inventive compositions are unstable and disintegrate. Also, the application of inventive compositions containing less than about 5% of organopolysiloxane fluid to surfaces does not result in the desired glossiness on the treated surfaces.

At the other extreme, if the level of the organopolysiloxane fluid is raised in excess of about 20% by weight, a further addition of emulsifier is required in order to maintain a stable aqueous emulsion composition, which, absent this further emulsifier, deteriorates and falls apart. However, raising the amount of emulsifier within the inventive composition has also been observed to depress the pH and raise the viscosity of the compositions. The addition of further amounts of a neutralizing salt is subsequently required to restore the high stability of the inventive compositions necessary for acceptable storage characteristics. The addition of this further amount of the neutralizing salt has the undesirable effect of further raising the viscosity of the inventive compositions, often to an inconvenient level as well as boosting the pH, regardless of the amount of emulsifier. Another undesirable effect of such high organopolysiloxane fluid weight percentages (>about 20 wt %) is the residual greasiness that is found on the treated surface after application. If a smooth, whitish milky emulsion composition exhibiting good shelf stability is desired, an organopolysiloxane fluid of viscosity between about 100 and 300 centistokes should be used, and yet more desirably an organopolysiloxane fluid having a value of about 100–200 centistokes is desirably employed. Most preferably, such a smooth milky white emulsion composition has an approximately neutral pH, i.e., between about 7.0–7.75.

Naturally, it is to be held within the purview of one skilled in the art that should differing pH levels be desired and/or should differing viscosities be found advantageous to a particular application, then an organopolysiloxane fluid exhibiting viscosity values outside of the preferred rate just described above, as well as the use of greater or lesser amounts of emulsifier and neutralizing salt constituent may be utilized and yet be held within the scope of the present inventive concept.

Notwithstanding the prior considerations, it is contemplated that it may be desirable to provide a cleaning composition within the scope of the present invention which has a viscosity so high as to be considered more gelatinous in nature rather than liquid. In such a case, the modification of the ranges thus described above for the constituents outlined is readily performed by way of routine experimentation so that the viscosity may be adjusted in order to provide such a gelatinous characteristic.

Such may be desired for example wherein the use of a dispensing apparatus other than an aerosol, or manually pumpable dispenser and the like is used. Such compositions may be particularly desirable wherein a gelled composition would be particularly beneficial.

The present invention further comprises an emulsifying agent. This constituent is essential to the water solubilization of the organopolysiloxane fluid. Emulsifying agents are quite variable in molecular structure, but generally comprise an amphipathic structure with an oil-soluble hydrocarbon chain and a water-soluble ionic or polar group. One good example is a carboxylate, such as a high molecular weight carboxypolyalkylene. An example of such a material is a polyacrylic acid resin. The carboxylic side groups of this resin are ionized in the presence of a basic pH-adjusting agent. Ionization is necessary to activate the resin by uncoiling it, exposing the acidic side chains, promoting hydrophilic interactions and enabling the necessary emulsion to be formed. Other examples of the emulsifying agents which are particularly preferred are carboxypolymethylene resins, e.g. materials marketed under the tradename CARBOPOL (The B. F. Goodrich Co., Cleveland Ohio). Specific examples of CARBOPOLS are those marketed as CARBOPOL 1621 and CARBOPOL 1622.

Such emulsifying agents are present in the inventive emulsion composition to the extent that they are effective to promote emulsification. They are generally used from about 0.1 wt % to about 1.0 wt %. A more desirable wt% range is from about 0.20 to about 0.32% based on the weight of the aqueous emulsion composition as a whole.

Nonionic surfactants are also added to the new compositions. It is believed that small particle size of the organopolysiloxane fluid droplets (which can be less than about 2 microns) in the inventive emulsion composition greatly facilitates penetration of the organopolysiloxane fluid into the surface to be protected. To that end, nonionic surfactants are added to the present composition in order to yield smaller emulsion particle sizes. Thus, the nonionic surfactants act as secondary emulsifiers and it is expected that known nonionic surfactants can be used.

Desirable nonionic surfactants include linear and branched primary and secondary and alkylaryl alkoxylated alcohols. The surfactant group preferably consists of linear and branched primary and secondary alkoxylated alcohols. Even more preferably, the surfactant group consists of linear primary and secondary ethoxylated alcohols. Most preferably, the surfactant group consists of linear primary and secondary ethoxylates of carbon chain length of between 8 and 18 atoms.

Examples of particularly useful nonionic surfactants are alcohol alkoxylates such as those marketed under the tradename POLY-TERGENT SL-series of surfactants (Olin Corp.). Other examples of nonionic surfactants are alkoxylated glycols and glycol esters such as PEGOL F 88 (Rhone-Poulenc Surfactant and Specialty Division) and INTERWET (Akzo Chemicals Inc.). Such nonionic surfactants should be present with the inventive emulsion compositions in amounts that ensure stable emulsions. An example of such an amount is 0.1% to 6% by weight. Particularly useful is the weight % range of from 0.5% to 5% by weight.

An amino-functional organopolysiloxane-containing fluid is included in the compositions described in the invention. Such are typically provided in the form of an aqueous emulsion. The addition of such a constituent aids in the reduction of the undesirable greasy feel of the residual silicone layer after it is deposited upon the treated surfaces and has been allowed to dry. Further, the addition of this constituent is believed to provide an improved protective layer to the treated surface.

The amino-functional organopolysiloxane-containing fluid desirably comprises amino-functional dimethylpolysiloxanes. Especially useful are amino-functional dimethylpolysiloxanes which, by way of non-limiting examples, include N,N-dialkyl dimethylpolysiloxanes, N,N-diaryl dimethylpolysiloxanes, and N-alkyl-N-aryl dimethylpolysiloxanes. Mixtures of the above are also suitable.

It has been found that the inclusion of up to about 10% by weight, based on the total weight of the inventive composition, of a commercially available amino-functional organopolysiloxane-containing fluid provides increased adherence to the surface to be protected. These fluids typically contain 35% to 50% active amino-substituted organopolysiloxanes by weight, with an additional 10% emulsifier, 5% rust inhibitor, and approximately 65% water by weight. An example of such a commercially available fluid is Dow Corning Cationic 929 Silicone Emulsion. This combination is particularly advantageous for treatment of metal surfaces. The present composition may be formed with amounts of amino-functional dimethylpolysiloxane-containing fluids from about 2% to about 8% by weight, or more desirably, about 4% to about 6% by weight, based on the weight of the amino-functional fluid.

In order to obtain a maximal cleaning benefit sought in the new composition, one or more anionic surfactants are required. Useful anionic surfactants are exemplified by various alkyl-, aryl- and alkylaryl- sulfates and sulfonates. Further examples of these are classes of compounds such as alkylphenols, and sulfated acids, amides, and esters and particularly salts thereof. Sulfonates such as alkylbenzenesulfonates, alkylarenesulfonates, and ester-, amide-, or ether-linked sulfonates are also useful and their salts are particularly useful. A particularly well-known example is the anionic surfactant sodium lauryl sulfate. This constituent is desirably present in the inventive composition from 0.01% to 5% by weight, and preferably from about 1 to about 2% by weight.

Compositions of the invention further comprise at least one organic solvent constituent, such as a member of the general solvent class of alcohols, glycols or polyols. Useful organic solvents include, for example, glycol ethers including the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Preferred are glycol ethers having one to five glycol monomer units. These are $C_3$–$C_{15}$ glycol ethers. Examples of more preferred solvents include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof.

More preferably employed as the solvent is one or more of the group consisting of ethylene glycol n-butyl ether, diethylene glycol n-butyl ether, dipropylene glycol n-propyl ether, dipropylene glycol n-butyl ether and mixtures thereof. Many of these materials are readily commercially available, including materials presently marketed under the tradename DOWANOL (Dow Chemical Co., Midland Mich.) or marketed under the tradename CARBITOL (Union Carbide Co., Danbury Conn.).

Desirably, the use of two or more glycol ethers provides for these adjustment and solubility characteristics of this constituent in the compositions. For example, it is very desirable to select a first glycol ether having an increased affinity, (i.e., solubility) for the organopolysiloxane fluid and use it in conjunction with a second or further glycol ether constituent which may have an affinity for water. In such a way, the solubility balance as well as the overall miscibility of the organopolysiloxane fluids, known to be difficult to solubilize and/or emulsify in an aqueous carrier, may be adjusted. Particularly beneficial is the use of, for example, propylene glycol n-propyl ether in conjunction with propylene glycol n-butyl ether.

The organic solvents are present in the composition in amounts from 0.1 to about 10% by weight. The weight range can also be from about 2 to about 8% by weight, based on the weight of the inventive composition.

The compositions may also contain one or more optional constituents. the total weight of which do not exceed about 20% by weight, preferably 10% by weight, based on the total weight of the inventive compositions.

The compositions according to the invention further desirably incorporate a pH-adjusting constituent. Such constituents are utilized in order to adjust the pH of the overall inventive composition, as well as to ionize the acidic sidechains of the carboxypolyalkylene emulsifier. Acids and bases are generally useful as pH-adjusting constituents, as well as known buffer compositions. Commonly used and generally available examples are such compounds as the alkali metal salts of the hydroxide ion.

The amount required is generally that which is necessary to adjust the pH to a nominally neutral value; this has been observed to be from about 0.001 to about 0.5 wt %. This wt % range is desirably from about 0.20 to about 0.45%.

Trace levels of metal impurities can lead to instability of emulsions. Therefore, the use of water-soluble salts of organic chelating agents is found to be desirable as a way of effectively removing metal impurities from the emulsion. A wide variety of salts may be utilized including, but not limited to, ethylenediaminetetraacetic acid (EDTA), N-hydroxyethyl ethylenediaminetriacetic acid (HEDTA), as well as other acetic acids and particularly salts thereof.

Ethylenediaminetetraacetic acid is used due to the fact that it is readily commercially available in plentiful supply, and has been found to be effective in the compositions of the invention. While any effective amount can be used, particularly useful amounts are from about 0.2 to about 0.3 wt %.

A further useful constituent, which is desirably included in the aqueous emulsion compositions of the invention, includes a preservative such as a biocide, mold retarding agent, and the like. Many of these are well known to the art and are commercially available and includes those which are based on terpenes, as well as proprietary compositions including KATHON ICP (Rohm & Haas, Philadelphia, Pa.), NUOCEPT 95 which is available from Hüls (Piscataway, N.J.).

With regard to the biocidal composition according to the invention, these may be virtually any which provide antimicrobial efficacy against gram positive, or gram negative, but desirably both gram positive and gram negative bacteria. Many of these materials are known and include any of a number of known preservative compositions including, but not limited to: parabens, glutaraldehyde, formaldehyde, 2-bromo-2-nitropropane-1,3-diol, 2-methyl-4-isothiazoline-3-one, and mixtures thereof. Further useful exemplary and commercially available preservative components include, but are not limited to RHODAPON (Rhône-Poulenc Surfactant and Specialty Division, Cranbury, N.J.), NUOCEPT C and NUOCEPT 95 (50% wt. actives) (Hüls, Piscataway, N.J.) which is described as including an active constituent based on polymethoxy bicyclic oxazolidine.

The biocidal compositions may be used individually or in mixtures or two or more, and it is only required that they not be undesirably degraded when they are used in the processes described hereinafter. Also, it is desired that these have at least some measure of affinity although they are not necessarily required to be soluble within the carrier material within which they are dispersed, mixed, or interspersed. The biocidal composition also desirably features a low toxicity profile and thus its use in the household is not expected to be particularly deleterious to the occupants. The biocidal composition also desirably exhibits good compatibility with a broad range of surfactant compositions, especially anionic and nonionic surfactants that are optionally included in the articles according to the invention. Others, although not particularly recited here may be used, and mixtures of two or more biocidal composition may be used.

In one particularly preferred embodiment, the invention is described as comprising from 5 to 20% by weight of a organopolysiloxane fluid, from 0.1 to 1.0% by weight of an emulsifier, from 0.1 to 6% by weight of a nonionic surfactant including at least one alkoxylated alcohol or alkoxylated alkylphenol, from 2 to 8% by weight of an amino-functional organopolysiloxane-containing fluid, from 0.01 to 5.0% by weight of a sulfated or sulfonated anionic surfactant, and from 0.1 to 10% of one or more organic solvents. Water forms a part of the inventive composition and desirably deionized water is used.

In another aspect, the invention features a method of making the composition described above. While the compositions according to the invention may be readily produced by simply providing the individual constituent to the water and stirring using a conventional mixing apparatus and without particular regard to the rate of addition or the order addition of the constituents, the formulations are preferably produced generally in accordance with the following generalized protocol.

To a conventional low shear mixing apparatus is provided a quantity of the water which may be a total amount of water or may be an amount which is slightly less. Subsequently, the water is agitated to ensure that stirring of the water occurs at a moderate rate, yet at a rate which is desirably not so fast as to cause entrainment of air and undesired foaming or bubbling. Afterwards, the emulsifier is slowly added and dispersed in the stirring water followed by the organopolysiloxane fluid. The composition should be allowed to stir for sufficient period of time, generally several minutes, such that an even oil-in-water emulsion is produced. Afterwards, the nonionic surfactant is added. The surfactant further aids in emulsification of the organopolysiloxane fluid in the water and helps to reduce the particle size so that a visibly whitish emulsion is desirably formed. The remaining constituents may thereafter be added in any order during the continued stirring of the vessel containing the formulation. Desirably, subsequent to the addition of the emulsifier and nonionic surfactant, the pH is adjusted so that the emulsifier is neutralized prior to the addition of the remaining constituents.

The mixture is allowed to stir in order to ensure the homogenization and distribution of all the constituents, and to maintain the appearance of the emulsion. Afterwards, optionally but desirably the mixture is moved and introduced into a conventional homogenizer apparatus. Afterwards, the formulation may be removed and provided into a storage container or alternately may be used directly.

The invention also provides a method of cleaning a surface, comprising the steps of applying to the surface an amount of the previously described aqueous emulsion composition sufficient to clean the surface, distributing the composition on the surface with a cleaning implement such as a rag, cloth, sponge, paper towel or other like material, and removing the emulsion composition from the surface with the cleaning implement, accompanied by rubbing, buffing, polishing or like actions.

The invention will be further described in the following examples, which do not limit the scope of the invention described in the claims.

EXAMPLES

To demonstrate the compositions according to the invention, various formulations were prepared having the constituents that are indicated on Table 1 below, wherein the amounts given are the weight percent of each respective constituent.

Preparations of the formulations were performed in a routine manner, generally in accordance with the following protocol. The constituents were provided "as is" from their respective manufacturers, which corresponds to the weight percentages of active ingredients as shown in Table 2. To a large glass beaker placed on a magnetic stirrer apparatus was added less than the total amount, or the total amount, of deionized water. The temperature of the water, as well as that of the remaining constituents was approximately room temperature (68° F., 20° C.). The stirrer apparatus was activated, and to the water measured amounts of each of the constituents was added. While order of addition of the constituents is not believed to be important, generally the surfactants were added to the stirring water and allowed to become well dispersed prior to the addition of the remaining constituents. After the addition of the final constituent, the contents of the beaker were allowed to stir for a period of 5 to 15 minutes to ensure homogeneous mixing and the production of a uniform formulation. Each of the formulations was observed to be shelf stable for a period of weeks and months.

TABLE 1

| | Ex. 1 | Ex. 2 | Ex. 3 | Ex. 4 | Ex. 5 | Ex. 6 | Ex. 7 |
|---|---|---|---|---|---|---|---|
| Carbopol ® 1621 | 0.32 | 0.30 | — | 0.30 | — | — | 0.25 |
| Carbopol ® 1622 | — | — | 0.20 | — | 0.25 | 0.25 | — |
| Silicone Fluid (100 cst) | — | — | 15.00 | — | — | — | — |
| Silicone Fluid (500 cst) | 20.00 | 20.00 | — | 20.00 | 20.00 | 20.00 | 20.00 |
| Triton ® X-100 | 0.32 | 0.50 | — | 1.00 | 1.00 | 1.00 | 1.00 |
| Poly-Tergent ® SL-55 | — | — | 3.00 | — | — | — | — |
| Nuocept ® 95 | 0.20 | 0.20 | 0.20 | 0.20 | 0.20 | 0.20 | 0.20 |
| Rhodapon ® LCP | 2.00 | 2.00 | 1.00 | 2.00 | 2.00 | 2.00 | 2.00 |
| Dowanol ® DPnP | 5.00 | 5.00 | 5.00 | 5.00 | 5.00 | 5.00 | 5.00 |
| Dowanol ® DPnB | 5.00 | 5.00 | 5.00 | 5.00 | 5.00 | 5.00 | 5.00 |
| KOH | 0.45 | 0.40 | 0.20 | 0.40 | 0.30 | 0.30 | 0.40 |
| Dow Corning Cationic ® 929 Silicon Emulsion | 7.50 | 7.50 | 4.50 | 7.50 | 7.50 | 7.50 | 7.50 |
| Chelating agent | — | — | 0.25 | — | — | — | — |
| DI water | 59.21 | 59.10 | 65.65 | 58.60 | 58.75 | 58.75 | 58.65 |

The inventive compositions described in Table 1 were easily applied to surfaces with a cleaning implement (rag, sponge, paper towel, cloth towel, and the like). They provided cleaning and a glossy shine to treated surfaces.

The specific identities of the constituents indicated on Table 1 above are listed in Table 2, below.

TABLE 2

| | |
|---|---|
| Carbopol ® 1621 | carboxypolymethylene (100% actives) |
| Carbopol ® 1622 | carboxypolymethylene (100% actives) |
| Silicone Fluid (100 cost) | dimethylpolysiloxane (100% actives) |
| Silicone Fluid (500 cost) | dimethylpolysiloxane (100% actives) |
| Triton ® X-100 | nonionic phenoxylated alcohol (100 wt % actives) |
| Poly-Tergent ® SL-55 | nonionic alkoxylated alcohol (100 wt % actives) |
| Nuosept ® 95 | proprietary preservative composition |
| Rhodapon ® LCP | sodium lauryl sulfate anionic surfactant (30 wt % actives) |
| Dowanol ® DPnP | dipropylene glycol n-propyl ether (100 wt % actives) |
| Dowanol ® DPnB | dipropylene glycol n-butyl ether (100 wt % actives) |
| KOH | aqueous KOH (28 wt % actives) |
| Dow Corning Cationic ® 929 Silicone Emulsion | aminoethylaminopropyldimethyl-siloxane composition (35 wt % actives) |
| chelating agent | sodium salt of ethylenediaminetetraacetic acid (38% weight actives) |
| DI water | deionized water |

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An aqueous emulsion composition comprising the following constituents:

(a) an organopolysiloxane fluid;

(b) an emulsifier;

(c) an amino-functional organopolysiloxane-containing fluid;

(d) a non-ionic surfactant including at least one non-ionic surfactant selected from a group consisting of alkoxylated alcohols and alkoxylated alkylphenols;

(e) an anionic sulfated or sulfonated surfactant; and (f) one or more organic solvents selected from the group consisting of propylene glycol n-propyl ether, propylene glycol n-butyl ether, isopropanol, 3-methoxy-3-methyl-1-butanol, ethanol, and mixtures thereof.

2. The aqueous emulsion composition of claim 1, further comprising one or more optional constituents selected from the group consisting of a pH adjusting constituent; a chelating constituent; a preservative constituent; a fragrance constituent; a coloring agent; and a thickener.

3. The aqueous emulsion composition of claim 1, wherein the organopolysiloxane fluid comprises dimethylpolysiloxane.

4. The aqueous emulsion composition of claim 3, wherein the dimethylpolysiloxane has the following structure wherein n has a value of between 50 and 1000

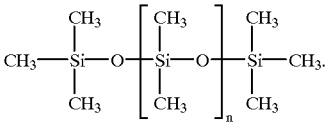

5. The aqueous emulsion composition of claim 4, wherein one or more of the methyl groups are substituted by vinyl, phenyl, trifluorophenyl or amino groups.

6. The aqueous emulsion composition of claim 1, wherein the emulsifier is a carboxypolyalkylene.

7. The aqueous emulsion composition of claim 6, wherein the carboxypolyalkylene is carboxypolymethylene.

8. The aqueous emulsion composition of claim 1 comprising at least about 5 wt % organopolysiloxane fluid, said fluid exhibiting a viscosity of at least about 50 centistokes.

9. The aqueous emulsion composition of claim 1 comprising at least about 15 wt % organopolysiloxane fluid, said fluid exhibiting a viscosity from about 100 to about 200 centistokes.

10. The aqueous emulsion composition of claim 1, wherein said organopolysiloxane fluid is present in an amount of from about 15 to about 20wt % and exhibits a viscosity from about 100 to about 200 centistokes, said emulsifier comprises a carboxypolymethylene, said non-ionic surfactant is a linear alkoxylated alcohol, said amino-function polysiloxane-containing fluid comprises a dimethylpolysiloxane amino-functionalized with an N-ethyl-N-propyl amino group, and said anionic surfactant is sodium lauryl sulfate.

11. An aqueous emulsion composition comprising the following constituents:

(a) from 5 to 20% by weight of an organopolysiloxane fluid;

(b) from 0.1 to 1.0% by weight of an emulsifier;

(c) from 0.1 to 6% by weight of a non-ionic surfactant including at least one non-ionic surfactant selected from a group containing alkoxylated alcohols and alkoxylated alkylphenols;

(d) from 2 to 8% by weight of an amino-functional organopolysiloxane-containing fluid;

(e) from 0.01 to 5.0% by weight of a sulfated or sulfonated anionic surfactant; and (f) from 0.1 to 10% by weight of one or more organic solvents selected from the group consisting of propylene glycol n-propyl ether, propylene glycol n-butyl ether, isopropanol, 3-methoxy-3-methyl-1-butanol, ethanol, and mixtures thereof.

12. A method of cleaning a surface, comprising the steps of:

(a) applying an effective amount of an aqueous emulsion composition of claim 1 to clean said surface;

(b) distributing the composition on the surface with a cleaning implement; and (c) removing the aqueous emulsion composition from the surface.

13. A method of making the aqueous emulsion composition of claim 1 comprising the steps of:

(a) adding the emulsifier to a stirred volume of water until dispersion is evident;

(b) adding the organopolysiloxane fluid to the mixture until an emulsion is produced;

(c) adding the nonionic surfactant to the emulsion;

(d) adjusting the pH of the emulsion;

(e) adding the remaining constituents to the emulsion; and (f) transferring the emulsion to a homogenizer and homogenizing.

14. The aqueous emulsion of claim 1, wherein the amino-functional organopolysiloxane-containing fluid comprises organopolysiloxanes amino-functionalized with N,N-dialkyl, N,N-diaryl, N-alkyl-N-aryl amino groups, or mixtures of these groups.

15. The aqueous emulsion composition of claim 11, which further comprises one or more additives selected from chelating constituents, pH adjusting constituents, preservative constituents, fragrance constituents, coloring constituents, and thickening constituents.

16. An aqueous emulsion composition which comprises:

(a) an organopolysiloxane fluid which has a fluid viscosity of at least about 50 centistokes;

(b) an carboxypolyalkylene as an emulsifier constituent;

(c) an amino-functional organopolysiloxane-containing fluid;

(d) a non-ionic surfactant including at least one non-ionic surfactant selected from the group consisting of alkoxylated alcohols and alkoxylated alkylphenols;

(e) an anionic sulfated or sulfonated surfactant;

(f) one or more organic solvents selected from the group consisting of propylene glycol n-propyl ether, propylene glycol n-butyl ether, isopropanol, 3-methoxy-3-methyl-1-butanol, ethanol, and mixtures thereof;

optionally, one or more further constituents selected from the group consisting of pH adjusting agents, chelating agents, and preservatives.

17. An aqueous emulsion composition which consists essentially of:

an organopolysiloxane fluid which has a fluid viscosity of at least about 50 centistokes;

an carboxypolyalkylene as an emulsifier constituent;

an amino-functional organopolysiloxane-containing fluid;

a non-ionic surfactant including at least one non-ionic surfactant selected from the group consisting of alkoxylated alcohols and alkoxylated alkylphenols;

an anionic sulfated or sulfonated surfactant;

one or more organic solvents selected from the group consisting of propylene glycol n-propyl ether, propylene glycol n-butyl ether, isopropanol, 3-methoxy-3-methyl-1-butanol, ethanol, and mixtures thereof;

optionally, one or more further constituents selected from the group consisting of pH adjusting agents, chelating agents, preservatives, fragrances, coloring agents, and thickeners.

* * * * *